US010578358B2

(12) United States Patent
McHugh et al.

(10) Patent No.: US 10,578,358 B2
(45) Date of Patent: Mar. 3, 2020

(54) INTERMITTENT INFRARED DRYING FOR BREWERY-SPENT GRAIN

(71) Applicants: The United States of America, as represented by the Secretary of Agriculture, Washington, DC (US); Regrained, San Francisco, CA (US)

(72) Inventors: Tara H. McHugh, Albany, CA (US); Roberto D. Avena Bustillos, Davis, CA (US); Donald A. Olson, Isleton, CA (US); Zhongli Pan, El Macero, CA (US); Daniel J. Kurzrock, San Francisco, CA (US); Jordan L. Schwartz, San Francisco, CA (US)

(73) Assignees: The United States of America, as represented by the Secretary of Agriculture, Washington, DC (US); Regrained, Inc., Burlingame, CA (US)

( * ) Notice: Subject to any disclaimer, the term of this patent is extended or adjusted under 35 U.S.C. 154(b) by 127 days.

(21) Appl. No.: 15/937,131

(22) Filed: Mar. 27, 2018

(65) Prior Publication Data

US 2019/0301797 A1 Oct. 3, 2019

(51) Int. Cl.

| | |
|---|---|
| ***F26B 3/30*** | (2006.01) |
| ***F26B 17/04*** | (2006.01) |
| ***F26B 25/04*** | (2006.01) |
| ***F26B 25/00*** | (2006.01) |

(52) U.S. Cl.

CPC ..... *F26B 3/30* (2013.01); *F26B 17/045* (2013.01); *F26B 25/002* (2013.01); *F26B 25/04* (2013.01); *F26B 2200/06* (2013.01)

(58) Field of Classification Search

CPC ..... F26B 3/30; F26B 3/305; F26B 25/002; F26B 25/04; F26B 17/04; F26B 17/045; F26B 2200/06

See application file for complete search history.

(56) References Cited

U.S. PATENT DOCUMENTS

| | | | | | |
|---|---|---|---|---|---|
| 2,419,875 | A | * | 4/1947 | Birdseye | F26B 3/283 34/431 |
| 2,428,090 | A | * | 9/1947 | Naeher | B02B 1/08 241/10 |
| 5,024,145 | A | * | 6/1991 | Bailey | A23B 9/04 34/266 |
| 5,233,763 | A | * | 8/1993 | Minnie, Jr. | F26B 3/283 110/223 |
| 5,557,858 | A | * | 9/1996 | Macaluso | F26B 3/283 34/203 |

(Continued)

FOREIGN PATENT DOCUMENTS

WO 201416811 10/2014

OTHER PUBLICATIONS

Farcas, Anca et al., A New Potential Ingredient for Functional Foods, Journal of Agroalimentary Processes and Technologies, 2014, pp. 137-141, vol. 20, No. 2.

*Primary Examiner* — David J Laux

(74) *Attorney, Agent, or Firm* — John D. Fado; Robert D. Jones

(57) ABSTRACT

The system for processing brewery spent grains (BSG) includes a specific intermittent infrared (IR) heating and stirring protocol designed to produce a unique dried BSG product that can be used whole or ground up and used as a quality flour suitable for human consumption.

20 Claims, 3 Drawing Sheets

(56) References Cited

U.S. PATENT DOCUMENTS

| | | | | |
|---|---|---|---|---|
| 6,105,273 | A * | 8/2000 | Johanson | B01J 8/08 34/267 |
| 2003/0150128 | A1* | 8/2003 | Macaluso | F26B 3/283 34/397 |
| 2007/0268778 | A1* | 11/2007 | Velsor | B01F 13/0013 366/7 |
| 2012/0005916 | A1* | 1/2012 | Lopez | A23K 10/38 34/398 |
| 2012/0244266 | A1* | 9/2012 | Ku | A23B 9/02 426/392 |
| 2014/0308411 | A1* | 10/2014 | Breslin | A23L 7/197 426/242 |

* cited by examiner

INTERMITTENT INFRARED DRYING FOR BREWERY-SPENT GRAIN

FIELD OF THE INVENTION

The disclosed product and process relate to novel drying and processing of brewery-spent grain (BSG). Specifically, the product and method described herein relate to a specific intermittent infrared (IR) heating and stirring protocol designed to produce a unique dried BSG product that can be used whole or ground up and used as a quality flour suitable for human consumption.

BACKGROUND OF THE INVENTION

BSG is the major byproduct of the brewing and distilling industry. On average, one pound of BSG is created for every six-pack of beer brewed. This adds up to tens of billions of pounds per annum, in the United States alone. Traditionally, breweries sell or donate this grain to farmers for use as animal feed, because despite its impressive nutritional profile, it spoils quickly. Fresh BSG has high water content, and is thus unstable. To render BSG into an ingredient for human consumption, careful and precise processing is required to produce a dehydrated product that is attractive and safe.

Food manufacturers increasingly seek opportunities to utilize nutrient dense and sustainable ingredients for the products that their consumers demand. That focus creates a robust marketplace for specialty, functional, and other value-added ingredients. Once processed, BSG can deliver a versatile, economical, and nutrient-dense grain blend that capitalizes on the potential of an overlooked, undervalued, and readily available latent supply chain.

Traditional off-the-shelf dehydration methods are energy intensive and expensive. Ultimately, traditional processes produce relatively small quantities (5-10%) of usable BSG products that can be incorporated into conventional foods without adversely affecting the taste, appearance, and/or quality of the food. The need exists for a BSG-based flour that is safe for human consumption and has more universally-appealing characteristics as a value-added ingredient.

As described herein, the inventors discovered that drying the BSG with intermittent infrared (IR) heating and precise stirring creates a uniquely energy efficient way to dry BSG that gives the final product novel benefits including reduced microbial load, increased crispiness, and a more pleasant aroma. With these new qualities and BSG's excellent nutritional value, BSG can be readily introduced as a nutritious, versatile, and delicious ingredient for human consumption. This closed loop model of simultaneously feeding people and reducing waste is an economically viable and environmentally sound component of a more sustainable food future.

SUMMARY OF THE INVENTION

This disclosure is directed to a system and method of processing brewery spent grains (BSG) so that a product of the method is safe for human consumption. In accordance with the method, unprocessed BSG is spread across a loading end of a conveyor belt. IR emitters are positioned about 8 inches above the conveyor belt. As the conveyor belt advances at a consistent speed, the BSG passes under about three linear feet of IR emitters and when the BSG is no longer under the IR emitters, the BSG is stirred for about three minutes. This heating and stirring process is repeated three more times (four times total), so that the produced product has a moisture content of less than 20% and is designated as "pre-dried BSG".

Optionally, an operator may elect to continue processing the BSG so that the BSG continues to move down the conveyor. The BSG passes under about two linear feet of IR emitters, and when the BSG is no longer under the IR emitters, the BSG is stirred for about three minutes. This heating and stirring process is repeated two more times (three times total)—and then the BSG passes under a final two feet of IR emitters—so that the BSG is fully processed to the extent desired by an operator (usually 10-12% by weight moisture). At the end of this process, the produced product is safe for human consumption.

DETAILED DESCRIPTION OF PREFERRED EMBODIMENTS

Figure 1:
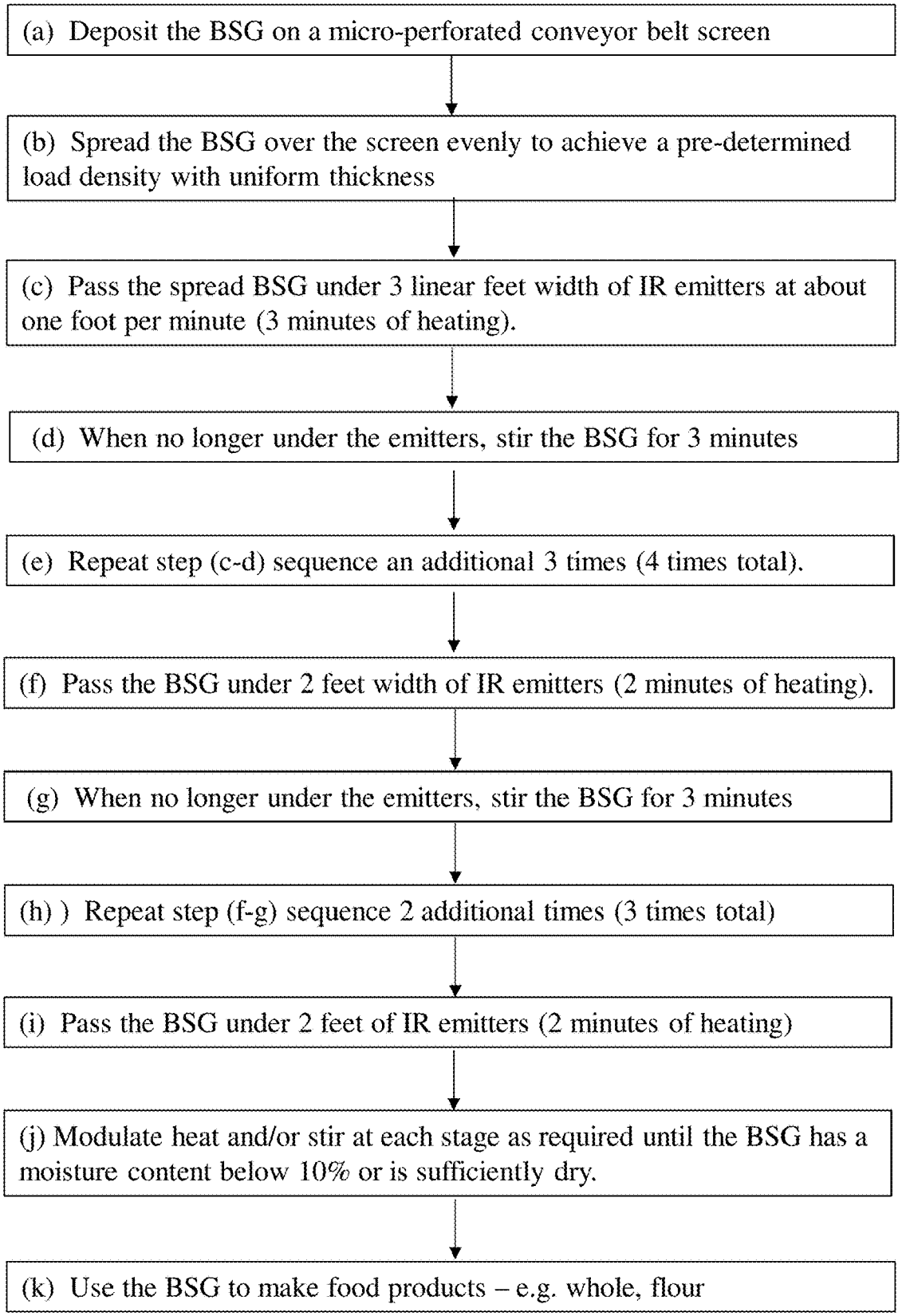
FIG. 1 is a flow chart listing the steps of the currently proposed process.

The current method comprises a process for drying BSG using infrared emitters so that the finished BSG product is safe for human consumption and suitable to be ground into flour. The flour can then be used to make various food products. As shown in FIG. 1, in the preferred embodiment, steps (a-k) describe the current process. In one alternative embodiment, the first five steps (a-e) can be used without the next five steps (f-j) to "pre-dry" the BSG. Pre-dried BSG can be stored for longer periods of time than fresh BSG while still being safe for human consumption once the BSG is fully dried.

For the purposes of this disclosure, "brewery spent grains (BSG)" is defined as a byproduct of the brewing industry. BSG is generally defined as the leftover malt and adjuncts remaining after the mash mixture has extracted most of the sugars and other carbohydrates during brewing. BSG is a lignocellulosic material containing about 73% fiber (17% cellulose, 28% non-cellulosic polysaccharides and 28% lignin) and 21% protein. In addition to its high fiber and protein content, BSG contains beneficial polyphenolics/antioxidants, all of which contribute to the positive nutritional value of BSG.

BSG is distinct and separate from brewery 'sludge'—which is generally considered a wastewater management problem. After the desired wort is removed, the spent yeast and hop leftovers found at the bottom of the fermentation tank and boil kettle comprise brewery sludge. While BSG is very high in moisture, it is decidedly not a 'sludge.' For the purposes of this disclosure, "brewery sludge" is defined as a "thick, soft, wet, mud-like sediment or viscous mixture of fine particles and liquid". In practice, a "sludge" is easily distinguishable from BSG by those skilled in the brewery arts.

Figure 2:
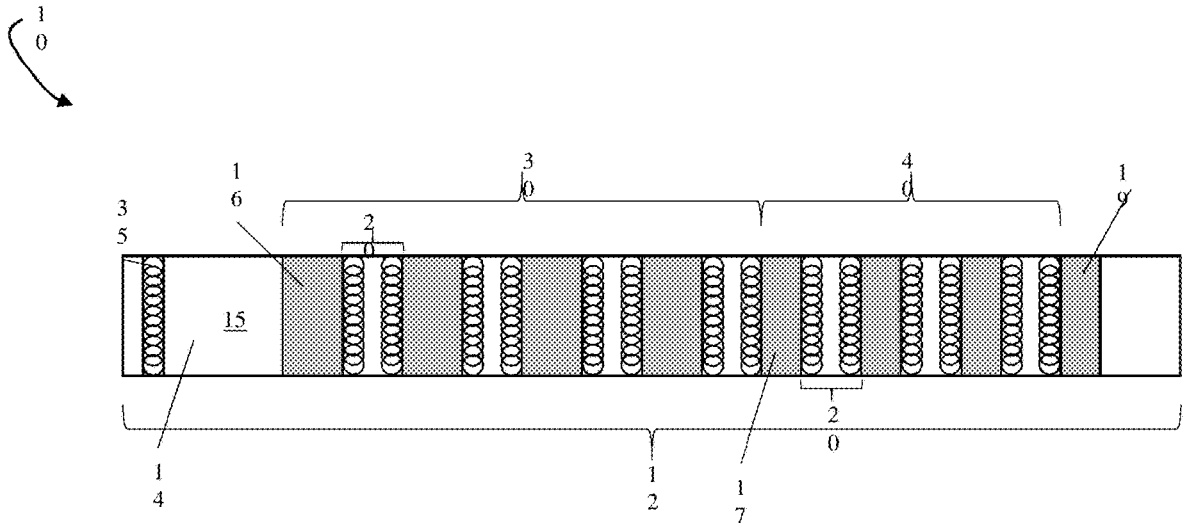
FIG. 2 is a top schematic scale view of the BSG drier system showing (among other things) the system heating and stirring zones.
Figure 3:
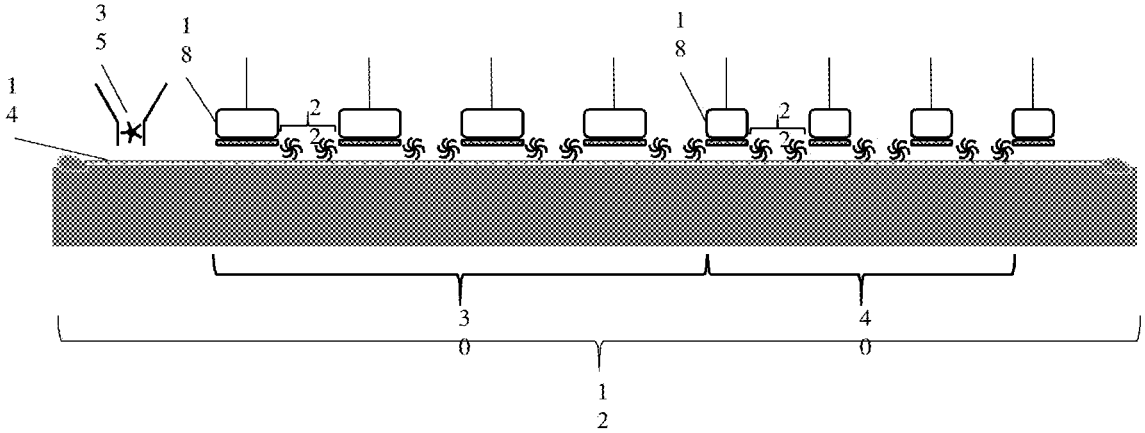
FIG. 3 is a profile scale view of the BSG drier schematically showing IR emitters and the mechanical BSG dispensing and stirring devices general positions relative to the conveyor system.

As generally described in the FIG. 1 flowchart, in the preferred embodiment, the BSG is dried/processed using the system shown schematically in FIGS. 2-3. FIGS. 2 and 3 show elevated and profile scale views (respectively) of the BSG dryer system 10—which is comprised of a continuous conveyor structure 12.

In the preferred embodiment, the BSG drier conveyor system/structure 12 is comprised of a micro-perforated conveyor belt 14 that is about 53 feet long (including the loading and unloading areas), and 6 feet wide. Note that in this disclosure, "long" refers to linear length in the direction of the conveyor advance, and "wide" refers to a lateral width perpendicular to the direction of the conveyor advance. The conveyor belt 14 is divided into two sections 30, 40 that are comprised of alternating heating 16, 17, and stirring 20 zones. The stirring zones 20 may or may not vary in rotational speed, depending in changes of BSG stickiness by their different moisture contents. FIG. 2 shows the infrared (IR) heating zones 16, 17 with different dimensions as shaded rectangular blocks, and the stirring zones 20 as unshaded rectangular blocks having one or more generally elliptical stirring patterns.

As best shown in FIG. 3, the heating zones 16, 17 coincide with the position of the IR emitters 18—which are positioned about 8 inches above the conveyor belt 14 so that BSG on the conveyor belt 14 is subjected to an IR radiant heat of about 312±31.3° C. The stirring zones 20 coincide with the position of mechanical stirrers 22. In normal operation, a conveyor belt 14 conveys the BSG at a rate of about one foot per minute.

In operation, the BSG drying process is initiated by spreading the BSG on a loading end 15 of the conveyor belt 14. In the preferred embodiment, as shown in FIGS. 2 and 3, the BSG is spread across the conveyor belt 14 using a mechanical dispenser 35 comprising a funnel-type hopper with a rotating shaft with spikes, paddles or wires at the funnel bottom to prevent clogging of the hopper/dispenser 35. The dispenser 35 is about as wide (laterally) as the conveyor belt 14 so that the dispenser 35 continuously dispenses a controlled amount of sticky fresh BSG on the loading end 15 of the conveyor belt. The BSG funnel dispensing unit 35 provides an ideal load density of 0.562 $lb/ft^2$ on the conveyor belt, however, the load density may be in the range of 0.5-0.9 $lb/ft^2$.

As best shown in FIG. 2, as the BSG proceeds down the conveyor, the BSG enters the first drying section 30, which is designed to "pre-dry" the BSG to about a 20% moisture content. As best shown in FIG. 2, in the first section 30, the BSG advances through four alternating sets of heating 16 and stirring 20 zones. Each of the heating zones 16 and each of the stirring zones 20 are three feet long. This process is shown/described in FIG. 1 steps (c-e). As noted above, optionally, BSG that is processed through the first section 30 of the BSG dryer system 10 is considered to be in a pre-dried state so that the BSG may be in condition to be stored.

As best shown in FIG. 2, in the second section 40 of the BSG dryer system 10, the BSG advances through three alternating sets of heating 17 and stirring 20 zones—and then one final heating zone 17. Each of the heating zones 17 is two feet long, and each of the stirring zones 20 are three feet long. The final heating zone 19 may be elongated or otherwise modified with different IR heating intensities to ensure that the BSG has a moisture content below 10% or is otherwise sufficiently dry. The drying process associated with the second conveyor system section 40 is shown/described in FIG. 1 steps (f-j).

In alternative embodiments, the moisture content may be higher or lower than 10% depending on the intended use of the BSG. Similarly, in alternative embodiments, the various parameters (i.e. length, width, height, speed, duration, etc.) may be modified to achieve varying effects and objectives.

As shown in FIGS. 2 and 3, the intermittent stirrer system is comprised of one or more rows of interspersed spikes, paddles or thin wires fixed on individual rotating shafts across the conveyor width close enough to the conveyor surface to allow scrapping, flipping and stirring of the BSG as it enters and leave the stirring zones 20. Rotation of the stirrers 22 can be modulated to account for reduction of BSG stickiness as the BSG is gradually dried.

In the preferred embodiment, for fully dried BSG, the milling process that grinds the dried BSG into flour further decreases the dried BSG's moisture content to make the BSG safe for long term storage so that the final moisture content is below 10%. As noted above, in alternative embodiments, the moisture may be as high as (for example) 12% if the BSG will be milled into flour. Table 1 summarizes the ideal and ranges of variable conditions for the components of the BSG drier.

TABLE 1

| Instrument Variable | Ideal | Range |
|---|---|---|
| Load Density of BSG | 0.562 $lb/ft^2$ | 0.5-0.9 $lb/ft^2$ |
| IR Emitter Radiant Temperature | 312° C. | 280.7-343.3° C. |
| First Section | 3 ft | 2.5-3.5 ft |
| Length of Each Heating Zone | | |
| First Section | 3 ft | 2-4 ft |
| Length of Each Stirring Zone | | |
| Second Section | 2 ft | 2-3 ft |
| Length of Each Heating Zone | | |
| Second Section | 3 ft | 2.5-3.5 ft |
| Length of Each Stirring Zone | | |

EXAMPLE

The described method was used to fully dry BSG. This procedure kept the BSG surface temperature below 100° C. during the first 75-80% of the drying time by using catalytic flameless gas-powered IR radiation emitters, set to 1.5" WC, which had an average surface temperature of 320.9±31.3° C. The BSG had a load density of 0.562 $lb/ft^2$ spread into an even layer. The BSG was manually stirred for three minutes after three minutes of heating. The BSG was spread into a homogenous layer. This sequence was repeated three more times (four times total). The BSG was then manually stirred for three minutes after two minutes of heating. The BSG was spread into a homogenous layer and this process was repeated two more times (three times total). The BSG was then heated for an additional two minutes. The total drying time was 41 min, including 20 min of IR heating and 21 min of stirring.

A comparison of the final product properties of the infrared dried product with those of traditionally hot air-dried product is shown in Table 2.

TABLE 2

| Category | Infrared Dried | Hot Air-Dried |
|---|---|---|
| Drying Time | 41 min | 120-150 min |
| Energy Efficiency | 37.3% | 0.9% |
| Color (L) | 53.040 ± 0.151 | 52.660 ± 0.159 |
| Color (a) | 2.883 ± 0.070 | 3.000 ± 0.017 |
| Color (b) | 13.827 ± 0.286 | 14.127 ± 0.172 |
| Texture (Peak force) | 32978 ± 18172 g | 8598 ± 3383 g |
| Stronger Aroma (% of people tested) | 84% | 16% |

TABLE 2-continued

| Category | Infrared Dried | Hot Air-Dried |
|---|---|---|
| Microbial Count of BSG dried after 6-7 h of storage (CFU/g) | <1000 | >1000 |
| Protein Dispersibility Index | 7.13% | 7.41 ± 0.16% |

Table 2 highlights the unique and unexpected benefits that this novel process provides to the final BSG product. This procedure fully dried the BSG to a 5.61±0.80% moisture content with a water activity of 0.2807 Aw. This process had a thermal energy efficiency of 37.3%. The dried BSG had a whitish index of 50.964±0.125 and color parameters (L, a, b) of 53.04±0.151, 2.883±0.070, and 13.827±0.286.

The BSG's texture was quantified with a peak force of 8598±3383 g. The dried BSG had a protein dispersability index of 7.13%. When dried with this method after 6-7 h of storage, the BSG also had a microbial count below 1,000 CFU, designating the BSG as safe for human consumption. According to a paired comparison test done by 25 untrained judges, 21 of them found that the BSG dried with the previously described method had a stronger fragrant aroma than hot-air dried BSG. The aroma was described as toasted cereal, wheaty, musty, yeasty, and alcoholic. The overwhelming proportion of judges that detected a stronger aroma of the IR dried BSG and the fact that the judges were not trained shows that the intermittent IR drying technique used, increased the strength of the desirable BSG aromas in ways that hot-air drying did not.

For the foregoing reasons, it is clear the method and apparatus described herein provides an innovative compact system that may be used for unique BSG drying and pre-drying applications. The current system may be modified in multiple ways and applied in various technological applications. The disclosed method and apparatus may be modified and customized as required by a specific operation or application, and the individual components may be modified and defined, as required, to achieve the desired result.

Although the materials of construction are not described, they may include a variety of composition and dimensions consistent with the function described herein. Such variations are not to be regarded as a departure from the spirit and scope of this disclosure, and all such modifications as would be obvious to one skilled in the art are intended to be included within the scope of the following claims.

The amounts, percentages and ranges disclosed herein are not meant to be limiting, and increments between the recited amounts, percentages and ranges are specifically envisioned as part of the invention. All ranges and parameters disclosed herein are understood to encompass any and all sub-ranges subsumed therein, and every number between the endpoints. For example, a stated range of "1 to 10" should be considered to include any and all sub-ranges between (and inclusive of) the minimum value of 1 and the maximum value of 10 including all integer values and decimal values; that is, all sub-ranges beginning with a minimum value of 1 or more, (e.g., 1 to 6.1), and ending with a maximum value of 10 or less, (e.g. 2.3 to 9.4, 3 to 8, 4 to 7), and finally to each number 1, 2, 3, 4, 5, 6, 7, 8, 9, and 10 contained within the range.

Unless otherwise indicated, all numbers expressing quantities of ingredients, properties such as molecular weight, reaction conditions, and so forth as used in the specification and claims are to be understood as being modified in all instances by the term "about." Accordingly, unless otherwise indicated, the numerical properties set forth in the following specification and claims are approximations that may vary depending on the desired properties sought to be obtained in embodiments of the present invention. Similarly, if the term "about" precedes a numerically quantifiable measurement, that measurement is assumed to vary by as much as 10%. The term "about" refers to a quantity, level, value, length, width, time, amount, or other numerically quantifiable dimension that varies by as much 10% relative to a reference quantity, level, value, distance/numerical dimension, time, amount, or other dimension.

Unless defined otherwise, all technical and scientific terms used herein have the same meaning as commonly understood by one of ordinary skill in the art to which the invention belongs. Although any methods and materials similar or equivalent to those described herein can be used in the practice or testing of the present invention, the preferred methods and materials are now described.

The term "consisting essentially of" excludes additional method (or process) steps or composition components that substantially interfere with the intended activity of the method (or process) or composition, and can be readily determined by those skilled in the art (for example, from a consideration of this specification or practice of the invention disclosed herein). The invention illustratively disclosed herein suitably may be practiced in the absence of any element which is not specifically disclosed herein.

What is claimed is:

1. A method of processing brewery spent grains (BSG) so that a product of the method is safe for human consumption, the method comprising the steps of:

(a) spreading unprocessed BSG on a conveyor belt at a loading end of the conveyor belt on a conveyor system;

(b) positioning infrared (IR) emitters above the conveyor belt;

(c) continuously advancing the conveyor belt at a consistent speed throughout the execution of the method;

(d) passing the BSG under about three linear feet of IR emitters, and when no longer under the IR emitters, immediately stirring the BSG for about three minutes;

(e) repeating step (d) three more times (four times total); and, (f) designating the BSG as "pre-dried BSG", the pre-dried BSG having a moisture content of about 20% by weight or less.

2. The method of claim 1 further comprising:

(g) passing the pre-dried BSG under about two linear feet of IR emitters, and when no longer under the IR emitters, immediately stirring the pre-dried BSG for about three minutes;

(h) repeating step (g) two more times (three times total);

(i) passing the pre-dried BSG under about two linear feet of emitters; and, (j) using the processed BSG to make a product that is safe for human consumption, wherein the moisture content of the BSG is less than about 12% by weight.

3. The method of claim 2 wherein, in steps (d) and (g), the BSG/pre-dried BSG is stirred by mechanical stirrers, the stirrers comprising one or more rows of interspersed spikes, paddles, and/or thin wires fixed on rotating shafts along the conveyor width, the stirrers being close enough to the conveyor surface to allow scraping, flipping and stirring of the BSG/pre-dried BSG as the BSG/pre-dried BSG enters and leave the stirring zones.

4. The method of claim 3 wherein rotation of the stirrers can be modulated to account for a reduction of BSG/pre-dried BSG stickiness as the BSG/pre-dried BSG is gradually dried.

5. The method of claim 2 wherein, in step (j), the product comprises flour.

6. The method of claim 1 wherein, in step (a), the BSG is gravitationally fed onto the conveyor belt through a funnel-type dispenser.

7. The method of claim 6 wherein, a rotating shaft with spikes, paddles, and/or wires is positioned at the bottom of the dispenser to prevent clogging of the dispenser.

8. The method of claim 1 wherein, in step (a), the conveyor belt is micro-perforated.

9. The method of claim 1 wherein, in step (a), the conveyor belt is about 53 feet long.

10. The method of claim 1 wherein in step (a), the conveyor belt is about 6 feet wide.

11. The method of claim 1 wherein, in step (a), the BSG is spread across the conveyor belt at a load density in the range of 05.-0.9 $lb/ft^2$.

12. The method of claim 1 wherein, in step (b), the IR emitters are positioned about 8 inches above the BSG on the conveyor belt.

13. The method of claim 1 wherein, in step (b), the IR emitters radiate 312±31° C. as measured at the surface of the BSG on the conveyor belt throughout the applicable steps of the method.

14. The method of claim 1 wherein, in step (c) the conveyor belt is continuously advanced at a speed of about 3 feet per minute.

15. The method of claim 1 wherein, in step (d), the stirrers are mechanical stirrers.

16. The method of claim 1 wherein, in step (d), there are multiple rows of stirrers in each stirring zone.

17. The method of claim 2 wherein, step (d), the BSG is stirred by mechanical stirrers, the stirrers comprising one or more rows of interspersed spikes, paddles and/or thin wires fixed on rotating shafts along the conveyor width, the stirrers b being close enough to the conveyor surface to allow scraping, flipping and stirring of the BSG as the BSG enters and leave the stirring zones.

18. The method of claim 17 wherein rotation of the stirrers can be modulated to account for a reduction of BSG stickiness as the BSG is gradually dried.

19. The method of claim 1 wherein, in step (f), the pre-dried BSG has a microbial count below 1000 CFU.

20. The method of claim 1 wherein, in step (f), the pre-dried BSG has a protein dispersability index of about 7.13%.

* * * * *